United States Patent [19]

Grether et al.

[11] Patent Number: 4,545,160

[45] Date of Patent: Oct. 8, 1985

[54] WINDOW

[75] Inventors: Paul Grether, Seuzach; Kurt Brader, Winterthur; Bruno Keller, Zurich, all of Switzerland

[73] Assignee: Sulzer Brothers Limited, Winterthur, Switzerland

[21] Appl. No.: 478,026

[22] Filed: Mar. 23, 1983

[30] Foreign Application Priority Data

Apr. 2, 1982 [CH] Switzerland ..... 2035/82

[51] Int. Cl.[4] ..... E06B 7/12

[52] U.S. Cl. ..... 52/172; 52/788

[58] Field of Search ..... 52/171, 172, 788, 479

[56] References Cited

U.S. PATENT DOCUMENTS 3,771,276 11/1973 Stewart et al. ..... 52/172

FOREIGN PATENT DOCUMENTS 469711 11/1950 Canada ..... 52/172
36657 9/1981 European Pat. Off. ..... 52/171
2350602 4/1975 Fed. Rep. of Germany ..... 52/171
130134 11/1980 Sweden ..... 52/172

*Primary Examiner*—Carl D. Friedman
*Assistant Examiner*—Naoko N. Slack
*Attorney, Agent, or Firm*—Kenyon & Kenyon

[57] ABSTRACT

The double pane window is provided with a drying chamber which is filled with desiccant and an antechamber which extends from the drying chamber to communicate with the surrounding environment at the opposite end. The antechamber prevents a direct exit of dry air from the enclosed space between the window panes into the surrounding atmosphere during "breathing" of the window as well as drawing in of moist ambient air into the drying chamber. The antechamber also brings about a considerable increase in the diffusion resistance for the water vapor diffusion into the desiccant or the space between the window panes.

17 Claims, 3 Drawing Figures

WINDOW

This invention relates to a window. More particularly, this invention relates to a window for inhibiting thermal flow. Still more particularly, this invention relates to a window of double paned construction.

As is known, various types of windows have been constructed for inhibiting a thermal flow. Generally, such windows are made with at least double glazing with the panes arranged in spaced relation from each other. In addition, the space between the panes is generally sealed from the surrounding medium in an air proof and water vapor proof manner.

However, double or multiple glazings for windows where the air space or the sum of the air spaces is more than about thirty millimeters can, in general, not be constructed in a gas tight insulated manner. This is because too high a pressure or vacuum would result in the space between the panes because of the temperature and/or barometric pressure variations on the windows. Further, open systems where there is an uncontrolled communication between the surrounding air and the space between the panes tend to form condensation on the inside surfaces of the glass panes. Thus, condensed water vapor as well as dust and gaseous admixtures of the ambient air can precipitate on these surfaces. Accordingly, periodic cleaning of the space between the glass panes becomes necessary. However, such cleaning operations are costly and, if sensitive selectively reflecting layers are provided, cleaning may not be permissible because of the danger of damaging the layers. Still further, because of the admixed air pollutants, the selectively reflecting layers may be destroyed.

In principle, the problems of the open systems can be overcome by pressure compensation relative to the ambient air through a controlled communication. In this regard, the communication between the space between the panes and the surrounding environment must be such that dust and pollutants from the environment are kept away from the space between the panes. Above all, the penetration of moisture into the space must be avoided to the extent possible. For this purpose, it has been known from Swiss Pat. No. 475,467 to fill the "breathing" openings of such windows with desiccants such as silica gel or molecular sieves (zeolites).

However, practice has shown that with conventional constructions, a sufficient absence of water vapor in the interior space between the panes cannot be achieved. Essentially, there are three different ways in which water vapor can come between the panes. The first way is the continual diffusion of moisture through the joint at the glass edge. This portion can be kept negligibly small by using a sealing technique which is known from insulation glass fabrication. A second way is through the breathing or pumping action of the panes due to mechanical and/or thermal load fluctuations such as wind pressure or temperature and barometric changes. The third way is by a continual diffusion of water vapor through the pressure compensating openings into the desiccant and, if the desiccant is moisture-saturated, into the space between the panes.

In conventional constructions, penetration of water into the space between the panes is not prevented to a sufficient degree because of the last two mentioned effects. Further, saturation of the desiccant occurs over relatively short periods of time so that the desiccant must be regenerated or replaced.

Accordingly, it is an object of the invention to provide a window of at least double paned construction in which water vapor can be effectively prevented from entering into a space between the panes.

It is another object of the invention to increase the service life of a desiccant in a thermal flow inhibiting window.

Briefly, the invention provides a window having at least two panes which are disposed in spaced relation to define a space, a drying chamber for receiving a desiccant and an antechamber to communicate with the drying chamber at one end and with a surrounding environment at the opposite end.

The drying chamber is disposed to extend at least over a partial length of the panes and communicates with the space between the panes adjacent one end. The antechamber likewise extends at least over a partial length of the panes and communicates with the surrounding environment via at least one opening.

When the window is installed, an air column exists in the antechamber which considerably increases the diffusion resistance for water vapor. Advantageously, the antechamber has a cross-sectional area which is smaller than the length. In particular, the ratio of the cross-sectional area to the length should be not more than $10^{-4}$ meters.

The construction is such that under a brief pumping thrust onto the panes caused, for example by gusts of wind, dry air from the interior or from the desiccant within the drying chamber does not pass directly into the surrounding medium but remains enclosed in the antechamber, at least to a large extent, and is thus preserved. During a subsequent countermovement, this air can flow back into the drying chamber or the space between the panes without having been admixed with any appreciable amount of moist ambient air from the surrounding environment. In order to increase the "buffer volume" of dry air, it is useful to provide compartments of enlarged cross-section over the length of the antechamber. Suitable desiccants or drying agents which may also serve as dust filters and/or filters for gaseous pollutants such as sulphur dioxide, hydrogen disulfide, nitric oxides, ozone, ammonia, hydrogen chloride, and the like, are silica gel and/or molecular sieves (zeolites). These desiccants may be used alone or in combination with active carbon, granulated clay or porcelain materials as well as glass or mineral fiber fabrics.

In order to suppress a short period pumping effect, for example due to a gust of wind, to the extent possible, the total flow resistance of the drying chamber and of the antechamber should be as high as possible. However, in order to prevent destruction of the window, the total flow resistance should not become too great. Accordingly, the flow resistance is made as low as possible on the basis of the mechanical strength of the window. The upper limit of the flow resistance is given by an empirical requirement that the temperature-related exchange of about 10% of the air volume enclosed between the glass panes in the course of one hour must not require a pressure difference greater than 600 Pa. This pressure difference corresponds to the minimum wind load to be taken into consideration in the construction of the window.

The drying chamber and antechamber can be accomodated in a structurally advantageous manner if they extend over the entire circumference of the window or, in the case of a rectangular or square window, if the chambers extend over at one side length.

If the interior surface of a pane is provided with a reflecting corrosion susceptible layer such a silver, copper or a metal oxide, it is advantageous to have a like corrosion susceptible substance present in the drying chamber in divided form in order to preserve the layer on the window pane. The distribution of the the corrosion susceptible substance in the desiccant can be achieved, for example, by impregnating the desiccant with colloidal silver or copper precipitated from salt solutions.

These and other objects and advantages of the invention will become more apparent from the following detailed description taken in conjunction with the accompanying drawings wherein.

Figure 1:
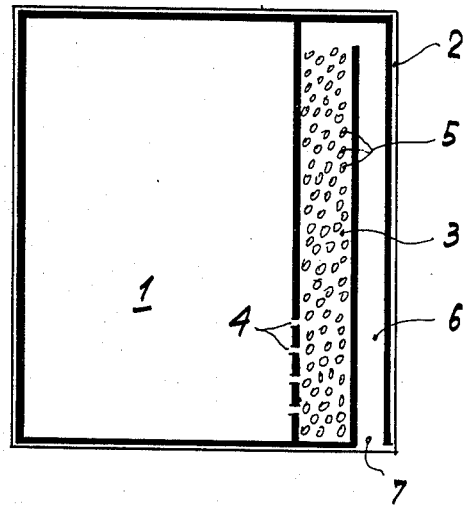
FIG. 1 illustrates a schematic view onto a window surface of a window constructed in accordance with the invention.

Referring to FIG. 1, the window has two panes (not shown) which are disposed in spaced relation to define a space 1 therebetween. This space 1 is enclosed by a frame (not shown) which is sealed along the entire circumference by means of a seal 2 of polysulfide and/or polyisobutyl in an air tight and water vapor tight manner.

In addition, the window includes a drying chamber 3 which extends between the panes and communicates with the space 1 at one end via a plurality of passage openings 4. The drying chamber 3 contains a drying agent or desiccant 5 over the length thereof. As indicated, the drying chamber 3 extends over one side of the window and communicates with an antechamber 6 at the upper end, as viewed. This antechamber 6 likewise extends along one side of the window and communicates with the surrounding environment via an inlet opening 7. As indicated, the width (cross-sectional area) of the drying chamber 3 is a multiple of that of the antechamber 6. For example, the absolute value of the cross-sectional area of the drying chamber 3 is between five and ten square centimeters.

When the window is installed, the drying chamber 3 and antechamber 6 permit a pressure compensation of any "breathing" of the window. That is, as described above, the dry air within the interspace 1 is able to pass into the drying chamber 3 and the antechamber 6 without passing into the surrounding environment before being drawn back into the interspace 1.

Figure 2:
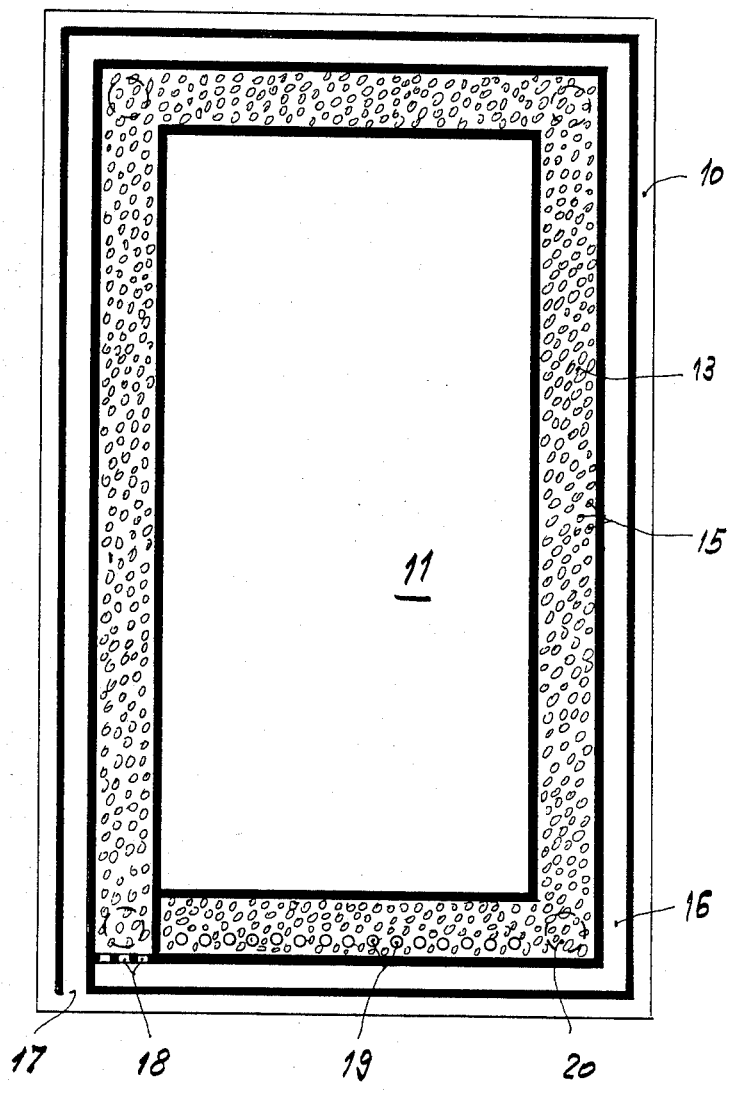
FIG. 2 illustrates a view similar to FIG. 1 of a modified construction in accordance with the invention having a drying chamber and antechamber about the entire periphery of the window.

Referring to FIG. 2, the window may be constructed with the panes (not shown) supported by a frame 10 which closes the space 11 between the panes off from the outside environment. This closure may also be made in a gas tight and water vapor tight manner to the extent possible by a suitable seal (not shown). As above, the frame is also provided with cavities which define a drying chamber 13 filled with a desiccant 15 and an antechamber 16. As shown, both the drying chamber 13 and the antechamber 16 extend along the entire circumference of the window.

At the outer end, the antechamber 16 communicates with the surrounding environment via an opening 17. At the opposite end, the antechamber 16 communicates with the drying chamber 13 via a plurallity of passage openings 18. In addition, the drying chamber has a plurality of bores 19 at the end which communicates with the space 11. Also, the corners of the drying chamber 13 are provided with openings which are closed by removable plugs 20. These openings permit filling of the drying chamber 13 with the desiccant 15 while also permitting replacement of the desiccant 15.

The flow resistance in the drying chamber 13 and antechamber 16 between th openings 17, 19 is reduced just only to the extent required for mechanical reasons. The major portion of the flow resistance is represented by the desiccant filled drying chamber 13. In addition, the diffusion resistance for water vapor is made as great as possible in the antechamber 16. To this end, the antechamber 16 is elongated as much as possible in the flow direction while the cross-section is held to a minimum. Thus, the length of the antechamber 16 in the flow direction is, for example, in general at least several decimeters but only a few square millimeters in cross-section so that the ratio of cross-section to length (which determines the difussion resistance) is about $10^{-4}$ meters or less. In the example illustrated in FIG. 2, a typical length of the antechamber 16 would be about 4 meters while the cross-sectional area is about one square centimeter. This gives a ratio of $\frac{1}{4}\times 10^{-4}$ meters.

Figure 3:
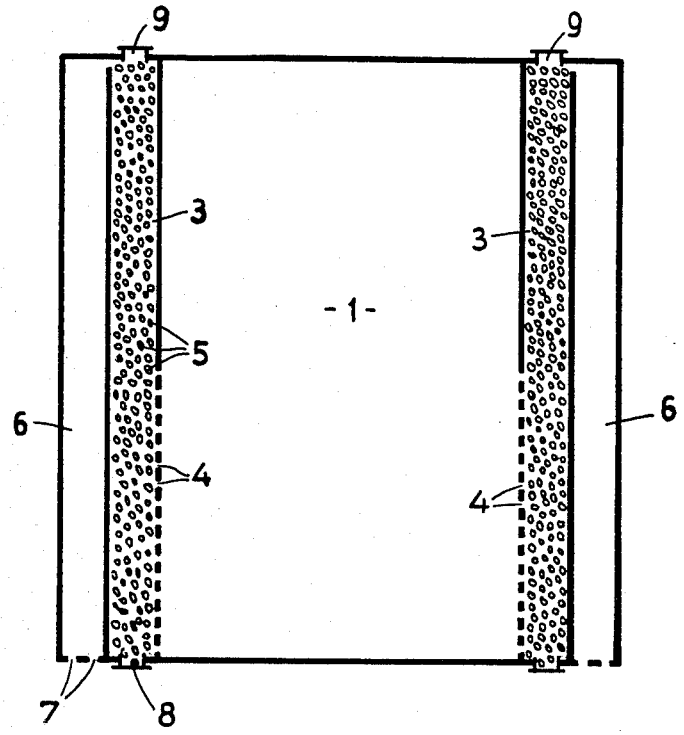
FIG. 3 schematically illustrates a further modified window construction in accordance with the invention.

Referring to FIG. 3, wherein like reference characters indicate like parts as above, the window may be provided with two parallel drying chambers 3 and two antechambers 6. As indicated, the drying chambers 3 and antechambers 6 extend over the height of the window on both sides of the interspace 1. The total volume of the two antechambers 6 thus form a buffer volume and, particularly, if the total volume is at least 100 cubic centimeters per square meter of pane or window surface. A high diffusion resistance for water vapor is insured for this construction by having relatively narrow inlet openings 7 to the surrounding atmosphere. As indicated, for each antechamber 6, two inlet openings 7 are provided each with a diameter, for example of one to two millimeters.

The buffer volume of the antechambers 6 has the purpose of keeping the losses of dry air as low as possible under relatively high frequency vibrations of the window due to alternating wind stresses. For this reason also, the diffusion inhibiting narrow inlet openings 7 are advantageous because the constitute an increased during "breathing out" and, thus, bring about a slight compression of the dry air in front of the openings 7.

As shown in FIG. 3, the drying chambers 3 are each provided at the bottom with a closed evacuating orifice 8 as well as with a closed filling orifice 9 at the top. In this way, the exchange or replacement of spent desiccant 5 can be simplified.

The invention thus provides a thermal flow inhibiting window having a relatively long useful life. In addition, the invention provides an insulated window which can be used over long periods of time without the need to clean the inside surfaces of the space between the window panes.

The invention also provides a thermal flow inhibiting window which is able to breath without drawing in water vapor from the surrounding environment.

What is claimed is:

1. A window having at least two panes disposed in spaced relation to define a space therebetween;

a drying chamber extending at least over a partial length of said panes and communicating with said space adjacent one end of said chamber;

a desiccant in said drying chamber which is characterized in being a dust filter and an absorbent for gaseous pollutants;

means for opening said drying chamber to permit removal of desiccant; and an antechamber extending at least over a partial length of said panes, said antechamber communicating at one end with a second end of said drying chamber and having at least one opening at an opposite end of said antechamber to communicate with a surrounding environment for pressure compensation.

2. A window as set forth in claim 1 wherein said antechamber has a cross-sectional area smaller than the length thereof.

3. A window as set forth in claim 2 wherein said cross-sectional area of said antechamber is in a ratio of not more than $2\times10^{-4}$ m relative to said length thereof.

4. A window as set forth in claim 1 wherein each said pane is of rectangular shape, said drying chamber extends over at least one side length of said panes and said antechamber extends over at least one side length of said panes.

5. A window as set forth in claim 1 wherein said drying chamber and said antechamber each extend over the circumference of the window.

6. A window as set forth in claim 1 further having a corrosion-susceptible reflecting layer on at least one of said panes within said space and particles of corrosion-susceptible material in said drying chamber.

7. A window as set forth in claim 1 wherein said antechamber has a plurality of openings at said opposite end thereof, each said opening having a small cross-sectional area to throttle a flow of air from said antechamber to the surrounding environment.

8. A window as set forth in claim 7 wherein said antechamber occupies a volume of at least 100 cubic centimeters per square meter of pane surface.

9. A window having a frame;

at least two panes disposed in sealed relation to said frame to define a space therebetween;

a corrosion-susceptible reflecting layer on at least one of said panes within said space;

a drying chamber of elongated length communicating at one end thereof with said space for receiving a desiccant;

a desiccant in said drying chamber which is characterized in being a dust filter and an absorbent for gaseous pollutants;

means for opening said drying chamber to permit removal of said desiccant; and an antechamber of elongated length extending from said drying chamber to at least one opening at an opposite end of said antechamber for communication with a surrounding environment for pressure compensation.

10. A window as set forth in claim 9 wherein said antechamber has a cross-sectional area to length ratio not more than $1\times10^{-4}$ meters.

11. A window as set forth in claim 9 wherein said drying chamber has a cross-sectional area of between five and ten square centimeters.

12. A window as set forth in claim 9 wherein said antechamber has a cross-sectional area of about one square centimeter and a length of four meters.

13. A window as set forth in claim 9 wherein said antechamber has a volume of at least 100 cubic centimeters per square meter of pane surface.

14. A window as set forth in claim 9 wherein said antechamber has two openings at said opposite end each of a diameter of from one to two millimeters.

15. A window as set forth in claim 14 wherein said antechamber has a volume of at least 100 cubic centimeters per square meter of pane surface.

16. The window as set forth in claim 9 which further comprises particles of corrosion-susceptible material in said drying chamber.

17. A window having at least two panes disposed in spaced relation to define a space therebetween;

a corrosion-susceptible reflecting layer on at least one of said panes within said space;

a drying chamber for receiving a desiccant, said chamber extending between said panes at least over a partial length of said panes and communicating with said space adjacent one end of said drying chamber;

a desiccant in said dyring chamber characterized in being a dust filter and an absorbent for gaseous pollutants;

particles of corrosion-susceptible material in said drying chamber;

an antechamber extending between said panes at least over a partial length of said panes, said antechamber communicating with said drying chamber at an end opposite said one end of said drying chamber and at least one opening at an opposite end of said antechamber to communicate with a surrounding environment for pressure compensation; and means for opening said drying chamber to permit removal of said desiccant.

* * * * *

UNITED STATES PATENT AND TRADEMARK OFFICE

CERTIFICATE OF CORRECTION

PATENT NO. : 4,545,160

DATED : October 8, 1985

INVENTOR(S) : Paul Grether, Kurt Brader and Bruno Keller

It is certified that error appears in the above-identified patent and that said Letters Patent is hereby corrected as shown below:

Column 2, line 67 change "accomodated" to -accommodated-

Column 3, line 2 change "at one" to -at least one-

Column 3, line 4 change "a" to -as-

Column 4, line 1 change "plurallity" to -plurality-

Column 4, line 3 change "communicates" to -communicate

Column 4, line 10 change "th openings" to -the openings-

Column 4, line 22 change "difussion" to -diffusion-

Column 4, line 40 change "example of" to -example, of-

Column 4, line 47 change "increased" to -increased resistance-

Signed and Sealed this

*Fourth* Day of *March 1986*

[SEAL]

*Attest:*

DONALD J. QUIGG

*Attesting Officer*

*Commissioner of Patents and Trademarks*